US008727550B2

(12) United States Patent
Burrows et al.

(10) Patent No.: US 8,727,550 B2
(45) Date of Patent: May 20, 2014

(54) HYBRID ELECTROLUMINESCENT ASSEMBLY

(75) Inventors: Kenneth Burrows, Gilbert, AR (US); Rodney K. Hehenberger, Lake Elmo, MN (US)

(73) Assignees: Oryon Technologies, LLC, Dallas, TX (US); 3M Innovative Properties Company, St. Paul, MN (US)

( * ) Notice: Subject to any disclaimer, the term of this patent is extended or adjusted under 35 U.S.C. 154(b) by 575 days.

(21) Appl. No.: 12/402,648

(22) Filed: Mar. 12, 2009

(65) Prior Publication Data

US 2010/0232143 A1 Sep. 16, 2010

(51) Int. Cl.

| | |
|---|---|
| ***F21V 9/16*** | (2006.01) |
| ***F21V 21/08*** | (2006.01) |
| ***F21V 21/084*** | (2006.01) |

(52) U.S. Cl.

USPC ..... 362/84; 362/103; 362/108

(58) Field of Classification Search

USPC ..... 362/84, 108

See application file for complete search history.

(56) References Cited

U.S. PATENT DOCUMENTS

| | | | | |
|---|---|---|---|---|
| 3,758,192 | A | | 9/1973 | Bingham |
| 4,684,353 | A | | 8/1987 | deSouza |
| 4,983,436 | A | | 1/1991 | Bailey |
| D314,673 | S | | 2/1991 | Legare |
| 4,999,936 | A | | 3/1991 | Calamia et al. |
| 5,237,448 | A | | 8/1993 | Spencer et al. |
| 5,272,562 | A | | 12/1993 | Coderre |
| 5,315,491 | A | * | 5/1994 | Spencer et al. ..... 362/84 |
| 5,567,040 | A | | 10/1996 | Tabanera |
| 5,570,945 | A | | 11/1996 | Chien et al. |
| 5,770,124 | A | | 6/1998 | Marecki |
| 5,856,029 | A | | 1/1999 | Burrows |
| 5,856,030 | A | | 1/1999 | Burrows |
| 5,980,976 | A | | 11/1999 | Burrows |
| 5,981,032 | A | | 11/1999 | Smith et al. |
| 6,086,213 | A | * | 7/2000 | Holce ..... 362/84 |
| 6,142,643 | A | * | 11/2000 | Araki et al. ..... 362/84 |
| 6,146,006 | A | * | 11/2000 | Cross ..... 362/555 |
| 6,261,633 | B1 | | 7/2001 | Burrows |
| D446,945 | S | | 8/2001 | Jacobs |
| 6,270,834 | B1 | | 8/2001 | Burrows |
| 6,309,764 | B1 | | 10/2001 | Burrows |
| 6,551,726 | B1 | | 4/2003 | Burrows |
| 6,696,786 | B2 | | 2/2004 | Burrows |

(Continued)

FOREIGN PATENT DOCUMENTS

| | | |
|---|---|---|
| CA | 2 487 264 A1 | 11/2004 |
| DE | 20313630 U1 | 9/2003 |

(Continued)

OTHER PUBLICATIONS

International Application No. PCT/US2010/026001 Search Report dated May 25, 2010.

(Continued)

*Primary Examiner* — David J Makiya

(74) *Attorney, Agent, or Firm* — Mueting, Raasch & Gebhardt, P.A.

(57) ABSTRACT

A hybrid electroluminescent assembly is described wherein the assembly includes one or more electroluminescent structures and a plurality of discontinuous retroreflective segments. Discontinuous retroreflective segments are disposed at least partially in the light path of the one or more electroluminescent structures.

27 Claims, 2 Drawing Sheets

(56) References Cited

U.S. PATENT DOCUMENTS

| | | | | |
|---|---|---|---|---|
| 6,717,361 | B2 | 4/2004 | Burrows | |
| 6,769,138 | B2 | 8/2004 | Golle et al. | |
| 6,859,941 | B2 | 3/2005 | Koppes | |
| 6,931,665 | B2 | 8/2005 | Feduzi et al. | |
| 6,964,493 | B1 | 11/2005 | Whitlock | |
| 6,974,610 | B1 | 12/2005 | Koppes | |
| 7,107,622 | B2 | 9/2006 | Feduzi et al. | |
| 7,144,127 | B2 | 12/2006 | Golle et al. | |
| 7,147,339 | B2 | 12/2006 | Golle et al. | |
| 7,156,528 | B2 | 1/2007 | Weiss et al. | |
| 7,220,011 | B2 | 5/2007 | Hurwitz | |
| 7,229,183 | B2 | 6/2007 | Golle et al. | |
| 7,229,184 | B2 | 6/2007 | Golle et al. | |
| 7,281,813 | B2 | 10/2007 | Golle et al. | |
| D587,907 | S | 3/2009 | Vandenberg | |
| D587,909 | S | 3/2009 | Carlson | |
| D594,663 | S | 6/2009 | Vandenberg | |
| D594,664 | S | 6/2009 | Otte | |
| 7,600,269 | B2 | 10/2009 | Feduzi | |
| 8,015,620 | B2 | 9/2011 | Feduzi | |
| 2002/0141060 | A1 | 10/2002 | Lu et al. | |
| 2005/0157390 | A1 | 7/2005 | Weiss | |
| 2006/0011287 | A1 | 1/2006 | Carlson | |
| 2006/0034064 | A1* | 2/2006 | Kanzler et al. | 362/84 |
| 2006/0044651 | A1 | 3/2006 | Mimura | |
| 2006/0092625 | A1* | 5/2006 | McKowen | 362/108 |
| 2006/0143772 | A1 | 7/2006 | Feduzi | |
| 2006/0291194 | A1 | 12/2006 | Golle et al. | |
| 2007/0056077 | A1 | 3/2007 | Feduzi | |
| 2009/0021831 | A1 | 1/2009 | Bacon, Jr. et al. | |
| 2010/0177517 | A1* | 7/2010 | Foley | 362/278 |
| 2010/0202143 | A1 | 8/2010 | Ruehlemann | |

FOREIGN PATENT DOCUMENTS

| | | | |
|---|---|---|---|
| DE | 202004011734 | U1 | 9/2003 |
| EP | 0 166 534 | A1 | 1/1986 |
| EP | 0 648 436 | A1 | 4/1995 |
| EP | 1 084 633 | A1 | 3/2001 |
| EP | 0594089 | | 6/2001 |
| EP | 0896683 | | 6/2001 |
| EP | 1127984 | | 8/2001 |
| EP | 0 759 179 | B1 | 11/2001 |
| EP | 1992240 | | 11/2008 |
| FR | 2 896 608 | | 1/2006 |
| GB | 1038469 | | 8/1966 |
| GB | 1424754 | | 2/1976 |
| GB | 2 408 915 | A | 6/2005 |
| GB | 2466027 | | 6/2010 |
| JP | 2005-077445 | | 3/2005 |
| JP | 2005-077448 | | 3/2005 |
| JP | 2006/228455 | | 8/2006 |
| WO | WO 91/18374 | | 11/1991 |
| WO | WO 94/25666 | | 11/1994 |
| WO | WO 98/20279 | | 5/1998 |
| WO | WO 98/20375 | A1 | 5/1998 |
| WO | WO 98/58281 | | 12/1998 |
| WO | WO 01/49941 | A2 | 7/2001 |
| WO | WO 03/007740 | A2 | 1/2003 |
| WO | WO 2004/100111 | | 11/2004 |
| WO | WO 2006/129246 | | 12/2006 |
| WO | WO 2007/065227 | | 6/2007 |
| WO | WO 2007/092152 | | 8/2007 |
| WO | WO 2008/142012 | | 11/2008 |
| WO | WO 2008/142012 | A1 | 11/2008 |

OTHER PUBLICATIONS

M 96 10 334 and M 97 00 908 DE Taste Sample Sheet Folder 13 of Oct. 1997, *Retro Reflecting Films for Speedometer Glass Lenses of the Type*1, 2, 3.

U.S. Appl. No. 29/248,189, filed Aug. 2, 2006, to Otte et al., entitled Segmented Retroreflective Article.

PCT International Seach Report for US2010/025994 dtd Nov. 5, 2011.

US D571,107, 06/2008, Otte et al. (withdrawn)

* cited by examiner

HYBRID ELECTROLUMINESCENT ASSEMBLY

FIELD OF THE DISCLOSURE

The present disclosure pertains to electroluminescent assemblies including electroluminescent structures used in combination with retroreflective segments and garments including such electroluminescent assemblies.

BACKGROUND

Electroluminescent lighting is commonly used in applications requiring light weight and low power illumination. Electroluminescent lamps are typically made of a layer of phosphor and a layer of dielectric disposed between two layers of electrodes where one electrode layer is transparent or translucent, allowing light to shine through it when the lamp is powered. Applications for electroluminescent lighting range from backlighting and illumination for displays to conspicuity lighting for garments. When electroluminescent lamps are used for garments, they can provide a good source of light in dark environments to increase the visibility of individuals wearing the garments.

Retroreflective materials are also commonly used for a variety of applications including road signs, vests, footwear, and other garments. Retroreflective materials can be created in a variety of ways, including using a layer of glass beads, a specular reflective agent disposed under the beads and a binder below the specular reflector. When incident light enters the bead, the bead focuses the light on the specular reflector. The specular reflector forces the light back through the bead so that it exits in the opposite direction of the incident light at the same angle, which is typically referred to as retroreflection. Retroreflective lighting is an excellent source of conspicuity in the dark when headlights or other incident light is reflected off of the retroreflective materials.

There remains a need for devices and materials that provide increased and/or improved conspicuity to their users under a variety of conditions.

SUMMARY

In one aspect, the present application is directed to an electroluminescent assembly including an electroluminescent structure and discontinuous retroreflective segments. The electroluminescent structure includes an electrode layer, a phosphor layer disposed over the electrode layer and a transparent electrode layer disposed over the phosphor layer. The discontinuous retroreflective segments are disposed over the electroluminescent structure and at least partially in a path of light capable of being emitted by the electroluminescent structure.

In another aspect, the present application is directed to an electroluminescent assembly including an electroluminescent structure and discontinuous retroreflective segments, wherein the electroluminescent structure and retroreflective segments form a flexible laminate structure. The electroluminescent structure includes an electrode layer, a phosphor layer disposed over the electrode layer and a transparent electrode layer disposed over the phosphor layer. The discontinuous retroreflective segments are disposed over the electroluminescent structure and at least partially in a path of light capable of being emitted by the electroluminescent structure.

In another aspect, the present application is directed to an electroluminescent assembly including multiple electroluminescent structures and discontinuous retroreflective segments. Each electroluminescent structure includes an electrode layer, a phosphor layer disposed over the electrode layer and a transparent electrode layer disposed over the phosphor layer. The retroreflective segments are disposed over the electroluminescent structures, with at least some of the discontinuous retroreflective segments being at least partially in a path of light capable of being emitted by the electroluminescent structures.

BRIEF DESCRIPTION OF THE DRAWINGS

The invention may be more completely understood in consideration of the following detailed description of various embodiments of the invention in connection with the accompanying drawings, in which.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

The present disclosure provides improved conspicuity materials for a variety of lighting conditions, including dusk and dark. The present disclosure combines the functionality of retroreflective materials with electroluminescent lighting to provide increased conspicuity by overlaying the two types of structures such that they function in a synergistic way. The compact construction of an electroluminescent assembly consistent with the present disclosure allows the assembly to be lightweight and flexible and even, in some cases, stretchable. Thus, a hybrid electroluminescent assembly consistent with the present disclosure can advantageously be disposed on thinner and more comfortable garments, for example, tee shirts, thin vests, etc.

Figure 1:
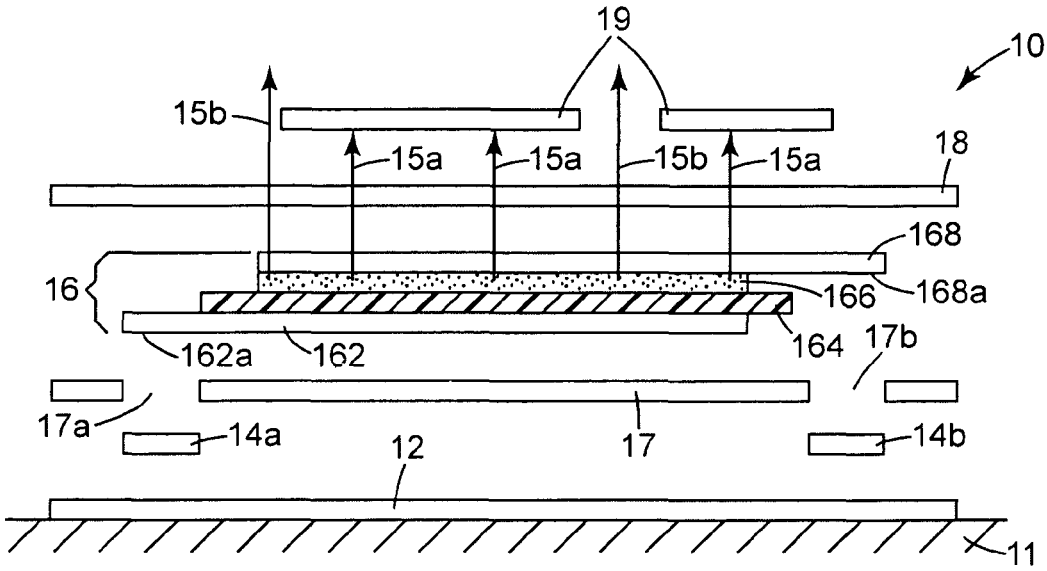
FIG. 1 shows an exploded cross-sectional view of an exemplary hybrid electroluminescent assembly.

FIG. 1 shows an exploded schematic cross-sectional view of an exemplary hybrid electroluminescent assembly 10. The assembly 10 can be disposed on a variety of substrates 11 including, but not limited to, cloth, plastic and other porous or nonporous materials. Adhesive 12 can be used to secure the adjacent components of the hybrid electroluminescent assembly 10, such as one or more of conductors 14*a*, 14*b*, electroluminescent structure 16 and protective layer 17, to the substrate 11. Alternatively, the electroluminescent assembly 10 can be printed, or disposed on a substrate 11 by other appropriate methods. An optional protective layer 17 can be included between substrate 11 and electroluminescent structure 16. Conductors 14*a*, 14*b* can include wires, conductive yarns, strips of conductive material such as copper, a bus bar, printed circuit conductors or other suitable conductors. While both conductors 14*a*, 14*b* are shown as disposed underneath electroluminescent structure 16 in FIG. 1, they can be disposed in other appropriate locations. One conductor (14*a*) must be electrically connected to electrode 162 and another conductor (14*b*) must be electrically connected to electrode 168. In embodiments including multiple electroluminescent structures 16, two or more conductors can be used to electrically connect the electroluminescent structures 16 to each other and to a power source. If conductors 14*a* and 14*b* are not insulated, additional insulation (not shown) may be provided as needed. The additional insulation may be in the form of one or more layers.

Referring further to FIG. 1, an exemplary electroluminescent structure 16 can include a first electrode layer 162, a dielectric layer 164, a phosphor layer 166 and a second electrode layer 168. Additional layers can be added or dielectric layer 164 can be removed. An exemplary electroluminescent structure can be made using a suitable unitary carrier, preferably capable of being deployed in gel form, such as a vinyl resin carrier, a urethane resin carrier (e.g., urethane acrylate) and other suitable materials. Exemplary materials suitable for use in the present disclosure are listed in U.S. Pat. Nos. 5,856,029, 5,856,030, 6,696,786, and 6,717,361. In some embodiments, the carrier can be UV curable and may include a catalyst. At least some or each layer can include the unitary carrier and some or all layers can also be doped with various additives. Such a carrier can be disposed on a wide variety of substrates, including metals, plastics, and non-woven and woven materials, such as cloth fabrics. Alternately, any other appropriate carrier could be used.

In one embodiment, the electroluminescent assembly can be at least partially, and, preferably, entirely monolithic. A monolithic structure can be created by suspending layers of the electroluminescent structure in a unitary common carrier as set forth in U.S. Pat. Nos. 5,856,029, 5,856,030, 6,696,786, and 6,717,361. The layers can be disposed, for example, by printing them one on top of another. When all layers are disposed, the structure can be solidified, e.g., by curing, and the layers will become strata in a monolithic mass. Although in FIG. 1 the constituent components are shown as discrete layers and elements, all of the layers of the electroluminescent structure 16, such as the first electrode layer 162, dielectric layer 164, phosphor layer 166 and second electrode layer 168 can be part of a monolithic structure. In other exemplary embodiments, any two, three, four, or more adjacent layers could form a monolithic structure consistent with the present disclosure. Additionally, protective layers 17 and 18 can also be part of a monolithic structure.

Doping the various layers of the monolithic structure can be achieved by mixing appropriate amounts of dopants with any suitable carrier, as described above. Dopants and amounts can be, for example, similar to those discussed in U.S. Pat. Nos. 5,856,029, 5,856,030, 6,696,786, and 6,717,361, or can be determined by using other suitable methods. First electrode layer 162 can include the unitary carrier doped with an ingredient to make the suspension electrically conductive. For example, silver or carbon in particulate form can be used as a dopant. Alternatively, gold, zinc, aluminum, graphite, copper, any combination thereof or any other appropriate ingredient may be used. The thickness of first electrode layer 162 can be, for example, about 8 to 12 microns or any other appropriate thickness to give serviceable results.

Dielectric layer 164 can include the unitary carrier doped with a dielectric such as barium-titanate powder or any other appropriate dielectric in particulate form. Dielectric layer 164 can be deposited in multiple layers to prevent the possibility of any pinholes in the layer 164. Dielectric layer 164 can have a thickness of about 15 to 35 microns, for example, or any other serviceable thickness.

Phosphor layer 166 can include the unitary carrier, such as vinyl gel resin, doped with electroluminescent grade encapsulated phosphor. An appropriate thickness for phosphor layer 166 can be 25 to 35 microns, or any other serviceable thickness. The color of light emitted by phosphor layer 166 is dependent on the choice of phosphor used in layer 166. A variety of colored dyes can be added to phosphor layer 166 to achieve a desired color of light, for example, blue, white, safety yellow or safety orange but those knowledgeable in the art will also note that adding colored pigments or dyes in other layers, e.g., protective layer 18, could also achieve a similar effect. For example, rhodamine can be added to phosphor layer 166 to achieve the appearance of white light when the electroluminescent structure 16 is energized. Additional admixtures can be combined with phosphor layer 166 to improve the performance of phosphor layer 166. Dielectric layer 164 preferably overlaps electrode layer 162 to prevent electrical contact between first electrode layer 162 and second electrode layer 168.

Second electrode layer 168 can include the unitary carrier doped with a suitable translucent or transparent electrical conductor to allow light to be emitted through second electrode layer 168. For example, the dopant for second electrode layer 168 can include indium-tin-oxide (ITO) in powder form or any other appropriate dopant. Second electrode layer 168 can have a thickness of about 5 microns or any other serviceable thickness.

Exemplary weights of dopants and methods for mixing each respective layer consistent with the present disclosure are described in detail, for example, in U.S. Pat. No. 6,551,726.

An electroluminescent structure as illustrated in FIG. 1 is not limited solely to the four layers depicted. Any number of layers resulting in a functional electroluminescent structure can be used.

Layers 162, 164, 166, 168 can be disposed using a variety of methods including coating or printing, e.g., silk-screen printing. When layers are screen printed, they can be printed in a series of intermediate layers to achieve a desired overall combined thickness. Layers can be cured, e.g., by exposure to ionizing radiation, such as heat or UV light or by any other appropriate method known to those skilled in the art.

Alternatively, layers 162, 164, 166, 168 can be distinct. Layers 162, 164, 166, 168 can be deposited by coating, printing, stacking or any other appropriate method. A transparent protective layer 18 can be deposited, for example, coated or printed, over the electroluminescent structure 16 to protect and/or seal the structure. An additional protective layer 17 can be deposited between electrode layer 162 and adhesive 12. Protective layers 17 and 18 can be larger than other layers so as to seal the electroluminescent structure 16 creating an envelope. Protective layers 17, 18 can provide insulation for the electrodes 162, 168, and can be made of any material reasonably resistant to environmental conditions and can provide protection to electroluminescent structure 16 from moisture, abrasion, etc. For example, protective layers 17, 18 can be made of any suitable materials, such as polymeric materials, including a vinyl resin carrier, a urethane resin carrier (e.g., urethane acrylate) and other suitable materials, e.g., those listed in U.S. Pat. Nos. 5,856,029, 5,856,030, 6,696,786 and other suitable materials known to those of ordinary skill in the art.

Conductors 14*a*, 14*b* can be disposed between adhesive 14 and protective layer 17. Protective layer 17 can have openings 17*a* and 17*b*, which allow leads 162*a* and 168*a* of first electrode layer 162 and second electrode layer 168, respectively, to come into electrical contact with conductors 14*a* and 14*b*. Alternatively, conductors 14*a*, 14*b* can be disposed in any appropriate location, and other methods known to those of skill in the art can be used to electrically connect conductors

14*a* and 14*b* with electrode layers 162 and 168. If multiple electroluminescent structures are used, one or more conductive structures, such as one or more conductors 14*a*, 14*b* can electrically connect each electroluminescent structures to a power supply, in series or independently. Additionally, conductors 14*a*, 14*b* may electrically connect each electroluminescent structure to an inverter.

Retroreflective segments 19 are discontinuous and can be deposited over the protective layer 18 or over the electroluminescent structure 16 or over any additional or alternative intervening layers by any suitable method. In one embodiment, retroreflective segments 19 can be purchased, for example, in the form of a transfer film, and secured to the electroluminescent structure 16, for example, using adhesive, such as a heat activatable adhesive, pressure sensitive adhesive, or any other suitable commercially available adhesives. Commercially available products that are particularly suitable for use in embodiments of the present disclosure include transfer films with discontinuous retroreflective segments removably disposed on a liner, which are available from 3M Company, St. Paul, Minn., under the Scotchlite™ brand. More particularly, 3M Scotchlite™ Reflective Materials, 5500 series Comfort Trim products may be used (e.g., 5510 and 5530 Segmented Trims). The discontinuous retroreflective segments in such products typically include a layer of beads embedded in a binder and often include heat activatable adhesive on the side of the binder opposite the beads. Such transfer films can be heat laminated to electroluminescent structure 16 through heat press lamination methods and the liner—removed to expose the discontinuous retroreflective segments. Alternatively, retroreflective segments 19 can be printed, coated, sewn or otherwise disposed on or attached to the electroluminescent structure 16.

In other embodiments, retroreflective segments can be made by methods such as those described in WO 94/25666. Glass beads can be embedded into a temporary carrier (bead carrier). Specularly reflective materials such as aluminum, silver, or cryolite can then be selectively vapor coated, screen printed, or otherwise disposed onto the exposed surface of the beads. A binder can be coated or otherwise disposed on the vapor coated reflective layer, and a heat activatable adhesive or another adhesion promoter can be provided. Optionally, one may include a release liner that can be adhered to the adhesive side to prevent adhesion during manufacturing or shipping or a fabric for alternative application for sewing the retroreflective segments on a garment. Prior to use on a garment, the bead carrier will be removed to expose the beads and allow retroreflection.

Retroreflective segments 19 can also be made by plotter cutting a desired image or shape into a commercially available retroreflective tape, such as 3M™ Scotchlite™ reflective transfer film, series 8700.

Figure 2:
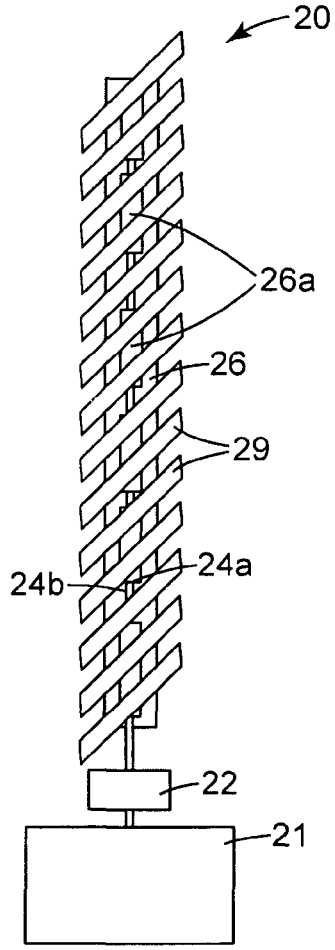
FIG. 2 shows a schematic diagram of a top view of an exemplary hybrid electroluminescent assembly.
Figure 3:
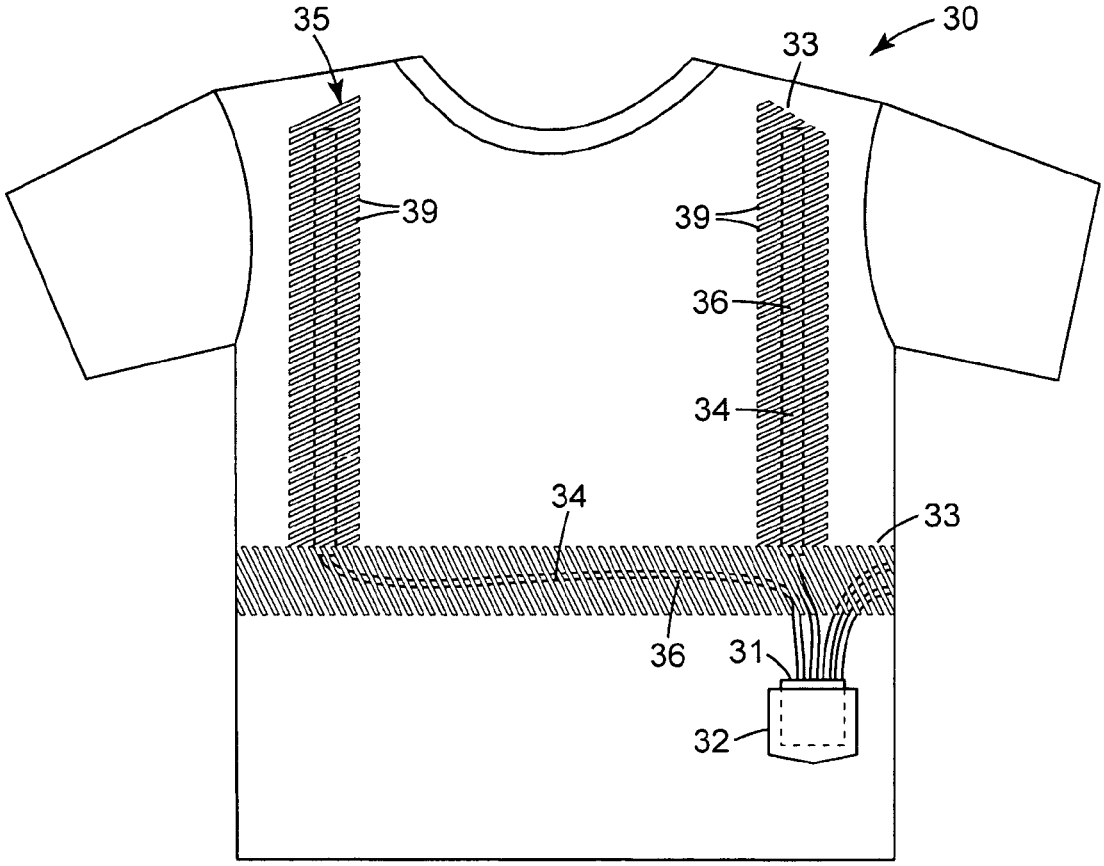
FIG. 3 shows an exemplary hybrid electroluminescent assembly disposed on a shirt.
Figure 4:
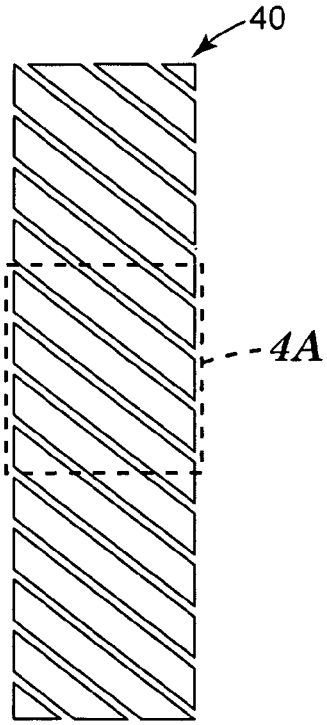
FIG. 4 shows an example of a pattern of discontinuous retroreflective segments defining retroreflective and non-retroreflective regions.

Retroreflective segments 19 can be disposed at least partially in the light path of electroluminescent structures 16, covering the area of an electroluminescent structure that otherwise would be illuminated. For example, the retroreflective segments can be arranged as stripes across the electroluminescent structures as shown in FIGS. 2, 3 and 4. Retroreflective segments 19 can overlap or intersect with electroluminescent structures 16 in any appropriate configuration so as to be at least partially in the light path of the structures as illustrated in FIG. 1.

Referring further to FIG. 1, discontinuous retroreflective segments 19 are at least partially in a path of light 15*a* capable of being emitted by the electroluminescent structure 16. For example the phosphor layer 166 emits light 15*a*, 15*b*. Because retroreflective segments 19 are disposed in the light path of the electroluminescent article, emitted light 15*a* is blocked while emitted light 15*b* passes between the retroreflective segments and can be visible to a viewer.

Retroreflective segments 19 can be of a variety of shapes and can be disposed in a variety of patterns. In some exemplary embodiments, retroreflective segments 19 can be rectangular, parallelograms, square or any other shape. Retroreflective segments 19 can be arranged in any configuration including, but not limited to, linear arrays, such as a sequence of parallel stripes shown in FIGS. 2, 3 and 4. Electroluminescent structures 16 can also be a variety of shapes depending on intended use and/or other considerations.

The present disclosure allows making exemplary hybrid electroluminescent assemblies 10 in which one or more electroluminescent structures and retroreflective segments form a laminate structure. For the purposes of the present disclosure, the term "laminate" shall mean that the structure is composed of layers of firmly attached materials and shall not be indicative of the process by which the structure is made or the layers are attached. Such exemplary embodiments are typically flexible and, in some cases, at least somewhat stretchable. This is most often the case for at least partially monolithic constructions and constructions including an elastomeric material.

For example, exemplary hybrid electroluminescent assemblies can be capable of being flexed or bent by a user under ordinary usage conditions. In some embodiments, a hybrid electroluminescent assembly can be characterized by a drape of no more than 700 g, preferably, no more than 600 g, more preferably, no more than 500 g, even more preferably no more than 400 g, and, most preferably, no more than 300 g. Drape may be measured as described in the Examples section below. The stretchability of an embodiment could be measured in terms of percent elongation prior to break by an Instron™ tensile tester. The Instron™ tensile tester has clamps to hold two ends of a sample, and will exert tensile force, pulling the ends of the sample farther apart until the sample breaks. An article that stretches further per amount of force applied has a lower modulus of elasticity and is generally more stretchable.

FIG. 2 shows a schematic diagram of an exemplary hybrid electroluminescent assembly 20. An electroluminescent element 26 includes a plurality of electroluminescent lamps or structures 26*a* that are connected to each other via conductors 24*a*, 24*b*. In this particular embodiment, retroreflective segments 29 can be disposed over and at least partially in the light path of electroluminescent lamps 26*a*. Conductors 24*a*, 24*b* can connect electroluminescent structures 26*a* to a power source 21. Optionally, conductors 24*a*, 24*b* may also connect the electroluminescent structures 26*a* to any other component, such as an inverter 22. The inverter 22 can convert DC power from the power source 21 to AC power for the electroluminescent lamps 26*a*. Alternatively, an AC power source can be used to provide power to the electroluminescent lamps. Additional suitable circuitry and conductors (not pictured) can be included, e.g., to cause the lamps to flash at different rates, provide safety shutoffs for short circuits, or allow for optimized power usage. Hybrid electroluminescent assembly 20 can be disposed on a garment or other articles. The inverter 22, where used, and/or power source 21 can be disconnected from the electroluminescent assembly 20 for battery replacement, washing, or other reasons. In some exemplary embodiments, the inverter can be disposed in the same case as the power source.

FIG. 3 shows an exemplary electroluminescent assembly disposed on an exemplary garment (here, a shirt). A shirt 30 is only one example of the numerous garments and other articles that an electroluminescent assembly of the present disclosure could be disposed on or included in. For example, an electroluminescent assembly could be disposed on a vest, a jacket, pants, gloves, shoes, hats, or any other type of garment. Such a garment can include a support 33 or garment shell that the electroluminescent assembly can be disposed on. For example, a support can be made of fabric, woven material, nonwoven material, rubber, plastic, leather or any other appropriate material. A garment can optionally include a pocket 32 or other means for supporting the power source 31 and/or inverter. A means for supporting power source 31 can be at any suitable location.

An exemplary hybrid electroluminescent assembly 35 disposed on a support 33 can include conductors 34 connecting electroluminescent structures 36 to each other and to a power source 31. Retroreflective segments 39 can be disposed over the electroluminescent structures so that they are partially in the light path of light capable of being emitted by the electroluminescent structures 36. Discontinuous retroreflective segments 39 can be of various shapes and can be configured in any appropriate layout. In the exemplary embodiment illustrated, discontinuous retroreflective segments 39 are disposed on the garment 30 to form right and left vertical sections that run up the front and the back of the shirt 30 on the left and right sides. Additionally, as discussed below, discontinuous retroreflective segments 39 can be configured in any way, for example, to meet the American National Standard for High-Visibility Safety Apparel ("the ANSI Standard") and other similar safety standards as described below.

Referring further to FIG. 3, electroluminescent structures 36 are disposed generally vertically (extending generally from the waist area toward the shoulder area of the wearer) on the right and left side of the shirt 30 on both the front and back. Fewer or more electroluminescent structures 36 can be used in on garment consistent with the present disclosure.

A hybrid electroluminescent assembly can be secured to a garment 30 by any appropriate means including, but not limited to, sewing the assembly to the garment, or securing the assembly to the garment with adhesive, such as pressure sensitive adhesive or heat activated adhesive, or by any other appropriate method.

Figure 4A:
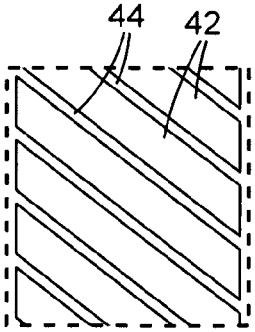
FIG. 4A shows a portion of the exemplary pattern of discontinuous retroreflective segments shown in FIG. 4.

FIGS. 4 and 4A show an example of a pattern 40 of discontinuous retroreflective segments defining retroreflective 42 and non-retroreflective 44 regions. In accordance with the present disclosure, the entire area of the non-reflective regions 44 or a portion of the area of the non-reflective regions 44 may be electroluminescent (i.e., emitting light due to electroluminescence of an underlying electroluminescent structure). When retroreflective regions 42 are arranged for safety garments, they can be designed to meet various safety standards. One such prominent standard is the ANSI Standard. The ANSI Standard dictates performance requirements for high visibility safety apparel, capable of signaling a user's presence in a conspicuously visible manner under any light conditions by day (this can be accomplished by use of fluorescent color) and under illumination by vehicle headlights in the dark (this can be accomplished by use of retroreflective materials). EN 471 is an example of a similar European standard, and many other countries such as Australia, New Zealand, and Canada also have their own standards.

Retroreflective regions 42 can be configured to meet minimum reflectivity requirements. This can be achieved by ensuring that a minimum percentage of the total surface area defined by a pattern 40 (also shown in FIG. 4A) of discontinuous retroreflective segments, here, retroreflective regions 42, sufficient to achieve the appropriate coefficient of retroreflectivity based on the reflective properties of the retroreflective segments. For example, if non-retroreflective regions 44 account for 50 percent of the surface area of a pattern 40 of discontinuous retroreflective segments, the brightness would be approximately 50 percent less than it would be if retroreflective materials were applied in a continuous pattern. In the stripe-like pattern 40 shown in FIG. 4, the retroreflective regions 42 occupy approximately 66 percent of the surface area of pattern 40 and non-retroreflective regions occupy approximately 33 percent of pattern 40. Alternatively, retroreflective regions 42 can occupy at least 50 percent, 75 percent, 85 percent or any other appropriate percentage of a pattern 40 of discontinuous retroreflective segments. The general principle of designing the retroreflective pattern 40 is to maximize the total retroreflectivity of the retroreflective regions 42 while maintaining and maximizing the visibility of light from electroluminescent structures below the discontinuous retroreflective segments that is visible through the non-retroreflective regions 44.

Patterns 40 of discontinuous retroreflective segments consistent with the present disclosure can be designed to meet the ANSI Standard. For example, Table 5 of the ISEA document American National Standard for High-Visibility Safety Apparel (ANSI/ISEA 107-2004) shows a head-on initial minimum required value of 330 $R_a$ (measured in units of candelas per lux per square meter) and a head-on operable minimum required value of 100 $R_a$. In some exemplary embodiments, the electroluminescent assembly can be characterized by an initial head-on $R_a$ of 330 or more and an operable $R_a$ of 100 or more.

EXAMPLES

Historically, the use of electroluminescent lamps has required a stiff, multi-layered construction of electrodes and phosphors along with bulky and stiff crimps and bus bars. When such an assembly is applied to a garment, the garment is somewhat stiff and can be uncomfortable. BeaconWear™ vests made by Safe Lites, LLC of Eden Prairie, Minn., ("Traditional Construction") used for comparison with exemplary embodiments of the present disclosure, included traditional electroluminescent lamps extending vertically on the right and left sides of the front and back of the vest. Additionally, traditional electroluminescent lamps extended horizontally around the sides of the vest. A strip of retroreflective reflective materials ran parallel to each electroluminescent lamp, on each side of the lamp.

One way of characterizing comfort and flexibility of a fabric is to measure its drape. The drape of Traditional Construction was measured using ASTM D6828 test methods. This procedure uses a piece of equipment commonly known as a 'handle-o-meter' to measure the amount of force that is required to bend the sample under test. A stiffer material will require a higher force and a more flexible material (better drape) will require less force. Drape was measured in grams.

Three samples of Traditional Construction were cut from each of two constructions of the lamp and underlying assembly, namely, the vertical and horizontal lamp arrangements. The composition and measured drape of each respective construction is shown in Table 1 below.

Drape for an exemplary embodiment of the current disclosure was also measured. Electroluminescent lamps were made as a monolithic construction such as one disclosed in U.S. Pat. Nos. 5,856,029, 5,856,030, 6,696,786, and 6,717,361. Scotchlite™ Comfort Trim Series 5510 available from 3M of St. Paul, Minn. was used to form retroreflective segments on top of the electroluminescent lamps. Conductive threads were used to electrically connect electroluminescent lamps to each other and to a power source. The assembly was disposed on a fabric substrate and its drape was tested.

TABLE 1

Comparison of Drape

| | Traditional Construction in vertical assembly | Traditional Construction in horizontal assembly | Embodiment of Present Disclosure |
|---|---|---|---|
| Construction Components | 1. Typical electroluminescent lamp<br>2. Bus bar<br>3. Ribbon carrier<br>4. Fabric substrate | 1. Typical electroluminescent lamp<br>2. Bus bar<br>3. Fabric substrate | 1. Monolithic lamp<br>2. Conductive threads/ assembly<br>3. Fabric substrate<br>4. 3M Scotchlite Comfort Trim |
| Sample a | 970 g | 747 g | 379 g |
| Sample b | 970 g | 780 g | 238 g |
| Sample c | 922 g | 812 g | 293 g |
| Average | 954 g | 780 g | 270 g |

One can see that the embodiments of the present disclosure all possessed considerably better drape when compared to either the vertical or horizontal assembly of the Traditional Construction.

A traditional way of measuring the stretchability of a fabric or article is to use an Instron™ tensile tester to exert tensile force on the article until it breaks. An article that stretches further per amount of force applied has a lower modulus of elasticity and is generally more stretchable. A 0.5 inch sample of the Embodiment of the Present Disclosure as described above was tested using an Instron™ tensile tester to determine the percent elongation of each sample prior to breaking.

TABLE 2

Stretchability Measurements

| | Embodiment of Present Disclosure |
|---|---|
| Construction Components | 1. Monolithic lamp<br>2. Conductive threads/assembly<br>3. Fabric substrate<br>4. 3M Scotchlite ™ Comfort Trim |
| Sample a | 52.16% |
| Sample b | 94.96% |
| Sample c | 61.44% |
| Average | 69.52% |

Once can see that an embodiment consistent with the present disclosure can have a percent elongation of at least 50 percent, at least 60 percent or at least 90 percent or more.

Positional terms used throughout the disclosure, e.g., over, under, above, etc., are intended to provide relative positional information; however, they are not intended to require adjacent disposition or to be limiting in any other manner. For example, when a layers or structure is said to be "disposed over" another layer or structure, this phrase is not intended to be limiting on the order in which the layers or structures are assembled but simply indicates the relative spatial relationship of the layers or structures being referred to. Further, all numerical limitations set forth herein shall be deemed to be modified by the term "about."

Although the present disclosure has been described with reference to preferred embodiments, those of skill in the art will recognize that changes made be made in form and detail without departing from the spirit and scope of the present disclosure.

What is claimed is:

1. An electroluminescent assembly comprising:

an electroluminescent structure comprising an electrode layer, a phosphor layer disposed over the electrode layer and a transparent electrode layer disposed over the phosphor layer;

a plurality of discontinuous retroreflective segments disposed over the electroluminescent structure and blocking light emitted by the electroluminescent structure;

wherein the electroluminescent assembly has a percent elongation of at least 50%.

2. The assembly of claim 1, wherein the plurality of discontinuous of retroreflective segments are secured to the electroluminescent structure.

3. The assembly of claim 1, wherein the retroreflective segments are disposed in a linear array.

4. The assembly of claim 1, wherein the retroreflective segments are shaped as generally parallel stripes.

5. The assembly of claim 1, wherein the electroluminescent structure is at least partially monolithic.

6. The assembly of claim 5, wherein at least two adjacent layers are stratified within a monolithic structure.

7. The assembly of claim 1, wherein the electroluminescent structure comprises an elastomeric material.

8. The assembly of claim 1, wherein the retroreflective segments comprise a plurality of beads at least partially embedded in a binder layer.

9. The assembly of claim 1, wherein at least fifty percent of a surface area of a side of the electroluminescent structure on which the retroreflective segments are disposed is substantially covered by retroreflective segments.

10. A garment comprising a support and the electroluminescent assembly of claim 1 disposed on the support.

11. The garment of claim 10, further comprising a power source connected to the electroluminescent structure.

12. The garment of claim 11, wherein the support comprises a pocket in which the power source can be disposed.

13. An electroluminescent assembly comprising:

an electroluminescent structure comprising an electrode layer, a phosphor layer disposed over the electrode layer and a transparent electrode layer disposed over the phosphor layer;

a plurality of discontinuous retroreflective segments disposed over the electroluminescent structure and blocking light emitted by the electroluminescent structure;

wherein the electroluminescent structure and retroreflective segments form a laminate structure; and wherein the laminate structure is flexible and has a percent elongation of at least 50%.

14. The assembly of claim 13, wherein the laminate structure is stretchable.

15. The assembly of claim 1, wherein light emitted by the electroluminescent structure does not transmit through the plurality of discontinuous of retroreflective segments.

16. The assembly of claim 13, wherein the laminate structure is characterized by a drape of no more than 400 g.

17. An electroluminescent assembly comprising:

a plurality of electroluminescent structures, each electroluminescent structure comprising an electrode layer, a phosphor layer disposed over the electrode layer and a transparent electrode layer disposed over the phosphor layer;

a plurality of discontinuous retroreflective segments disposed over the plurality of electroluminescent structures, at least some of the discontinuous retroreflective segments blocking light emitted by the electroluminescent structures;

wherein the electroluminescent assembly has a percent elongation of at least 50%.

18. The assembly of claim 17, wherein the retroreflective segments are disposed in a linear array.

19. The assembly of claim 17, wherein the retroreflective segments are shaped as generally parallel stripes.

20. The assembly of claim 17, further comprising a conductive structure connecting at least two electroluminescent structures.

21. The assembly of claim 17, wherein each of the plurality of electroluminescent structures is at least partially monolithic.

22. The assembly of claim 17, wherein the plurality of electroluminescent structures each comprise an elastomeric material.

23. The assembly of claim 17, wherein the plurality of retroreflective segments each comprise a plurality of beads at least partially embedded in a binder layer.

24. The assembly of claim 17, wherein at least fifty percent of a surface area of a side of each electroluminescent structure on which the retroreflective segments are disposed is substantially covered by retroreflective segments.

25. A garment comprising a support and the electroluminescent assembly of claim 17 disposed on the support.

26. The garment of claim 25, further comprising a power source connected to the electroluminescent structure.

27. The garment of claim 25, wherein the support comprises a pocket in which the power source can be disposed.

* * * * *